US008151498B2

(12) United States Patent
Zhu

(10) Patent No.: US 8,151,498 B2
(45) Date of Patent: Apr. 10, 2012

(54) ELECTRIC FIREPLACE FLAME CURTAIN WITH FIXED SIMULATED CARBON BED

(76) Inventor: Hongfeng Zhu, Zhejiang (CN)

( * ) Notice: Subject to any disclaimer, the term of this patent is extended or adjusted under 35 U.S.C. 154(b) by 119 days.

(21) Appl. No.: 12/372,995

(22) Filed: Feb. 18, 2009

(65) Prior Publication Data

US 2010/0205838 A1 Aug. 19, 2010

(51) Int. Cl.
*G09F 19/00* (2006.01)

(52) U.S. Cl. ..... 40/428; 219/218

(58) Field of Classification Search ..... 40/428
See application file for complete search history.

(56) References Cited

U.S. PATENT DOCUMENTS 1,336,500 A * 4/1920 Berry ..... 40/428
4,965,707 A * 10/1990 Butterfield ..... 362/96
2005/0086841 A1* 4/2005 Schroeter et al. ..... 40/428
2009/0251669 A1* 10/2009 Power ..... 353/38
* cited by examiner

*Primary Examiner* — Casandra Davis

(57) ABSTRACT

The invention relates to an electric fireplace flame curtain with fixed simulated charcoal bed comprises a transparent plate, a imaging mechanism and a charcoal bed being disposed on the transparent plate, and a number of fixed light-holding charcoals with plurality of transparent surfaces being disposed on the charcoal bed. The charcoal bed is fixed directly on the transparent plate with imaging mechanism, so the image of charcoal flame after optimization appears on the image screen, which has the best visual effect. The essential effect of the present invention is to solve the monotone flame and poor visual effect of the exiting electric fireplace. Meanwhile, the problems such as constant charcoal flame brightness, lack of reality are solved as well. The present invention could simulate a plurality of independent charcoal burning spots, with various styles. The light-spots of the flame are sparkling intermittently with bright and shade, and the flame is of light-holding effect. The visual effect and the authenticity are both perfect.

4 Claims, 4 Drawing Sheets

ELECTRIC FIREPLACE FLAME CURTAIN WITH FIXED SIMULATED CARBON BED

FIELD OF THE INVENTION

The present invention relates to an electric fireplace, more particularly, an electric fireplace flame curtain with fixed simulated charcoal bed.

BACKGROUND OF THE INVENTION

Conventional fireplace simulator structures are divided into two types by the simulation of the burning substance of the fireplace. One is a simulation of burning flame by projecting varying light onto an image screen with imaging operation. Such as the flame simulator of electric fireplace disclosed in the patent with publication date Sep. 5, 2007 and publication number CN 200944291, comprises a light source, a flame board, a translucent image screen, a light shade with a transparent hole, a simulative fuel bed in front of a housing chamber. The light shade with a transparent hole is disposed at the back of the flame board, and a glass screen is fixed in front of the image screen. The light source cooperates with the light shade, and the light shade cooperates with a transmission mechanism. In the structure described above, the light shade can be disposed either horizontally or vertically to cooperate with the transmission mechanism to achieve a kind of axial and radial move of the light. The light forms the shape of flame after passing through a flame hole disposed on the flame board, and then be projected onto the image screen and the glass screen to carry out the visual effect of flame with vertical rising and horizontal waving. The other one is a simulation of burning charcoal flame in the fireplace by disposing an unchangeable structure with wood-like or charcoal-like figure besides or under the lower portion of the image screen. Such as the electric fireplace with inner and outside charcoal bed and multiple layers of flame disclosed in the patent with publication date Jan. 7, 2009 and publication number CN 101338916, comprises a housing of the electric fireplace, an imaging light source disposed at the lower portion of the housing, a light process device disposed above the imaging light source, a simulative charcoal bed and a image screen disposed close to the charcoal bed. The simulative charcoal bed is disposed at both the front and back lower portions of the image screen, the height of the simulative charcoal bed disposed at the back of the image screen is higher than the height of the simulative charcoal bed disposed at the front of the image screen. The artificial wood for electric fireplace disclosed in the patent with publication date Apr. 7, 2004 and publication number CN 2610233 comprises an artificial wood base and a light source. The base is an irregular transparent chamber with artificial wood figure. LED tubes or light bulbs are disposed in the chamber. Each LED tubes or light bulbs are connected in series or in parallel and then lead out of the base by a conducting wire to connect with an external power source. The artificial wood base is of translucent material with pigment layers disposed irregularly on the external surface. The pigment layers can be chosen from various colors according to simulation needs, ordinarily, the dark brown similar to the wood color. As to the charcoal flame simulated through the similar mode such as the wood or charcoal bed with fixed structure, the change between shade and light of the flame color achieves mainly via the pigment layers smeared irregularly on the external surface of the wood or the charcoal bed.

Thus, the figure and the change between light and shade of the charcoal flame of each fireplace are constant and do not change, and be lack of alternant bright and shade sparkling light spots like the real charcoal burning and the reality. Furthermore, the charcoal bed described above could only be disposed besides the lower portion of the image screen, so the simulative charcoal flame appears only at the lower portion of the image screen. The configuration of the charcoal flame is monotonous, and the visual effect of the charcoal flame is affected.

SUMMARY OF THE INVENTION

To solve the inanimate charcoal flame configuration and poor visual effect of conventional electric fireplaces, the present invention provides an electric fireplace flame curtain with fixed simulated charcoal bed. The main object of the present invention is to simulate numerous independent burning spots, moreover, with multiple configuration and good visual effect.

The other object of the present invention is to provide a an electric fireplace flame curtain with fixed simulated charcoal bed with alternant bright and shade sparkling light spots and good reality, and to solve the problems such as the constant brightness of charcoal flame and the lack of reality.

According to one exemplary embodiment, the present invention relates to an electric fireplace flame curtain with fixed simulated charcoal bed comprises a transparent plate, a imaging mechanism and a charcoal bed being disposed on the transparent plate, and a number of fixed light-holding charcoals with plurality of transparent surfaces being disposed on the charcoal bed.

The charcoal bed is fixed directly on the transparent plate with imaging mechanism, so the image of charcoal flame after optimization appears on the image screen, which has the best visual effect. The charcoal bed is fixed directly on the transparent plate with the imaging mechanism, so the charcoal flame could occur on random location of the imaging screen, which improves the structure of conventional electric fireplace with the characteristics that the charcoal bed of is disposed close to the bottom of the imaging screen so the charcoal flame can only occur flakily at the bottom of the image screen, and a number of independent charcoal flame burning spots can be simulated on one piece of imaging screen, so as to provide various of visual effects. The image mechanism must be disposed on the flame curtain, so a transparent plate with flat or curved surface cuts the mustard of the structure requirement for imaging mechanism of normal electric fireplace. What needs to be illustrated is the transparent surface of the light-holding charcoal means a certain surface on the light-holding charcoal, the transparent surface allows the light passing through, refracts and reflects the transmitted light and reflects the external light, numerous times of refraction and reflection of light occurs inside a light-holding charcoal, between two light-holding charcoals, and between light-holding charcoal and image screen before the light-holding effect is finally achieved. Besides, the shape and size of the light-holding charcoal, together with the number and light transmittance of transparent surface could be adjusted to fit personal inclination, numbers of light-tight surfaces could be disposed on the light-holding charcoal.

Preferably, the transparent plate is of a flat or curved surface structure, the imaging mechanism is a mat structure disposed on the transparent plate, the area of the mat structure is smaller than or equal to the area of the transparent plate, the charcoal bed is disposed on the lower end or the bottom of the transparent plate, and the light-holding charcoals are attached on the transparent plate. The image mechanism must be disposed on the flame curtain, so a transparent plate with flat or curved surface cuts the mustard of the structure requirement for imaging mechanism of normal electric fireplace. The mat structure disposed on the transparent plate as the imaging mechanism of the electric fireplace (e.g., a frosting disposed on a sheet glass as imaging mechanism), the light-holding charcoals of charcoal bed could be fixed directly on either side of the transparent plate. Besides, the transparent plate could be of imaging film structure with coat disposed on it, but, in this case, the light-holding charcoals could not be disposed at on side of the imaging film because of the tenacity limit of the imaging film. The charcoal bed is disposed on the lower end or the bottom of the transparent plate, which leaves spaces for flame above the charcoal bed, normally, more than half height of the transparent plate could be left as the flame simulative space.

In the other exemplary embodiment, the transparent plate is of a flat or curved surface structure, the imaging mechanism is a thin image screen attached to the transparent plate, the size of the thin image screen is smaller than or equal to the size of the transparent plate, the charcoal bed is disposed on the lower end or the bottom of the transparent plate and the light-holding charcoal is attached on the image screen or/and the transparent plate. The thin image screen is an exiting technology, normally, with mat or frosting structure. Sufficient tenacity is achieved by combining the imaging screen with the transparent plate, and the charcoal bed could be disposed directly on the image screen. Besides, image screen with other structure could be adopted too.

As a special illustration, the charcoal bed could be disposed directly on a image screen with sufficient tenacity to accomplish the requirement of charcoal bed setting (e.g., a image screen with large thickness). In this case, the transparent plate disposed additionally is unnecessary, but the transparent plate structure is deemed to be included into the image screen.

Preferably, the light-holding charcoal is a transparent polyhedron with numerous refracting surfaces, a charcoal flame bright section is formed at where the light-holding charcoals are close to the imaging mechanism or the transparent plate, a wedge gap around the charcoal flame bright section is a light-holding section. The polyhedron light-holding charcoal with numerous refracting surfaces has the functions of refraction and reflection. Under the projection of irregular light from the electric fireplace flame generator, the refraction effect of the light-holding charcoal makes the light of a certain period and a certain angle focus on the imaging screen. Viewing from the image screen, the surface of the light-holding charcoal disposed close to the imaging screen forms a charcoal flame bright section which is similar to the sparkling light-spots of burning charcoal. The light from the flame generator is intermittent, the sparkling light-spots are intermittently bright and shade, which is very similar to the burning and lighting circumstance of real charcoal and the realism is strong. Further more, some light appears like being held in the charcoal bed after several times refraction and reflection by the light-holding charcoal, and a light-holding section is formed in the wedge gap around the charcoal flame bright section which makes people feel like that the flame stays in the gap space of the charcoal, the realism of the charcoal bed and the visual aesthetic feeling of the electric fireplace be farther improved. Besides, the light-holding charcoals can also be of a translucent structure. As the transparent effect of the translucent structure is relatively worse, the light transmittance of the charcoal bed is lower, and the brightness of sparkling light-spots and the light-holding section is of lower. However, the simulative charcoal flame of the charcoal bed has a haze feeling and thus another kind of prospect.

Preferably, a plurality of simulative charcoals with natural charcoal shape are disposed on the charcoal bed and the simulative charcoals are of transparent or translucent, a proportion of the simulative charcoals and the light-holding charcoals is from 1:2 to 1:8. By interlarding optimum amount of simulative charcoals with transparent or translucent structure in the light-holding charcoals, the charcoal bed structure is more close to the real charcoal flame. As to the simulative charcoals with transparent and translucent structure, the simulative charcoal with translucent structure is preferred because the relatively weak light transmit capability of the simulative charcoal with translucent structure makes the imaging screen looks darker thereon and some charcoals among the charcoal bed appears to be of burning less intensely. At the same time, the brightness of the outline of simulative charcoals with translucent structure under the projection of the light from the electric fireplace flame generator and the refracting and reflecting light from the light-holding charcoal with polyhedron structure is obviously greater than the brightness of the central portion of charcoals, which accords with the structure characteristics of charcoals at early stage of burning, and thus the simulation effect of the charcoal is obviously enhanced. Usually, the proportion of simulative charcoals and light-holding charcoals is 1:2 to 1:8. Too much simulative charcoal would influence the light-holding function of light-holding charcoal.

The light-holding charcoals or the simulative charcoals disposed on the charcoal bed are of monolayer structure or multilayer structure, the charcoal bed with multiplayer structure is preferred, the charcoals away from the transparent plate on charcoal bed with multilayer structure are fixed on the charcoals attached on the transparent plate. The light-holding charcoal with monolayer structure leaves charcoal gaps on the image screen and affects the reality of charcoal bed. Usually, the charcoal bed includes two to three layers of charcoals. Too much layers not only brings the volume and the cost increase, but also influences the light transmission, weakens the imaging effect of flame generator and reduces brightness of the charcoal flame. Furthermore, the concept of layer can not be very strict due to the various size and shape of light-holding charcoals and simulative charcoals. The charcoals are disposed in a cross bedded structure, the layers of charcoal disposed on different position of the transparent plate are different, and charcoal layer number on different position on transparent plate are different, so it is acceptable if the general thickness of the charcoal bed is consistent.

Preferably, the imaging mechanism and charcoal bed are disposed at the back of the transparent plate, the light-holding charcoals are fixed on the imaging mechanism, the transparent plate, imaging mechanism and the charcoal bed are of integral structure. Although the present invention allows the light-holding charcoals to be disposed at both the front and the back sides of the transparent plate, the exiting technology also disposes the charcoal bed at both the front and back sides of the image screen, and there is two structure, besides, the imaging mechanism is also be disposed at the front or back or both at the front and back of the transparent plate, the structures described above have different beneficial technical effects. Preferably, the imaging mechanism and the charcoal bed are disposed at the back of the transparent plate. The light-holding charcoals are disposed on the imaging mechanism. The transparent plate, the imaging mechanism and the charcoal bed are of integral structure. The flame curtain with this integral structure simplifies the structure of the electric fireplace, and the imaging mechanism is disposed close to the charcoal bed, which improves the flame definition and visual effect.

Usually, the flame curtain is disposed in front of an electric fireplace flame generator, the flame generator includes a rotating axis driven by an electric machinery and reflecting strips disposed on the rotating axis, or the flame generator is of axis sleeve type including central axis, rotating sleeve and reflecting strips disposed on the rotating sleeve. The flame curtain of the present invention is disposed on the front of the flame generator of electric fireplace. The transparent plate disposed on the flame curtain is on the same position with the traditional image screen of electric fireplace. Both the flame generator structures preferably described above are technically available. Others available flame generator structures could also be acceptable in the present invention application.

As a metamorphic exemplary embodiment of the flame curtain with transparent plate structure, a lower end of the transparent plate bends forward to be L-shaped portion, the charcoal bed has a L-shaped portion corresponding to the L-shaped portion of the transparent plate and is attached thereon. A charcoal bed with inclined structure is formed on the electric fireplace, which enhances the bottom structure and the three-dimensional characteristic of the charcoal flame structure, and gets close to its nature configuration. The bending structure could be disposed at the lower end of both the flat and the curved surface structure of the transparent plate.

Preferably, a flame generator is disposed below the bending section of the transparent plate, the flame generator includes a rotating axis driven by electric machinery and reflecting strips disposed on the rotating axis, or the flame generator is of axis sleeve type including central axis, rotating sleeve and reflecting strips disposed on the rotating sleeve. The bend portion of transparent plate is basically transverse. Light from the back of the transparent plate is difficult to form an well simulative image on the bending section of imaging mechanism. Thus, a bottom flame generator is particularly disposed at the bottom portion of the bend portion of the transparent plate, hereby the imaging light simulating the sparkling light-spot of the charcoal flame appears on the imaging mechanism at the bending section of the transparent plate, the realism of the charcoal flame is increased.

The essential effect of the present invention is to solve the monotone flame and poor visual effect of the exiting electric fireplace, meanwhile, the problems such as constant charcoal flame brightness, lack of reality are solved as well. The present invention could simulate a plurality of independent charcoal burning spots, with various styles. The light-spots of the flame are sparkling intermittently with bright and shade, and the flame is of light-holding effect. The visual effect and the authenticity are both perfect.

DETAILED DESCRIPTION OF THE INVENTION

Through the embodiments described subsequently and the drawings combined with, the technique detailed of the present invention could be fully understood.

Preferred Embodiment 1

Figure 1:
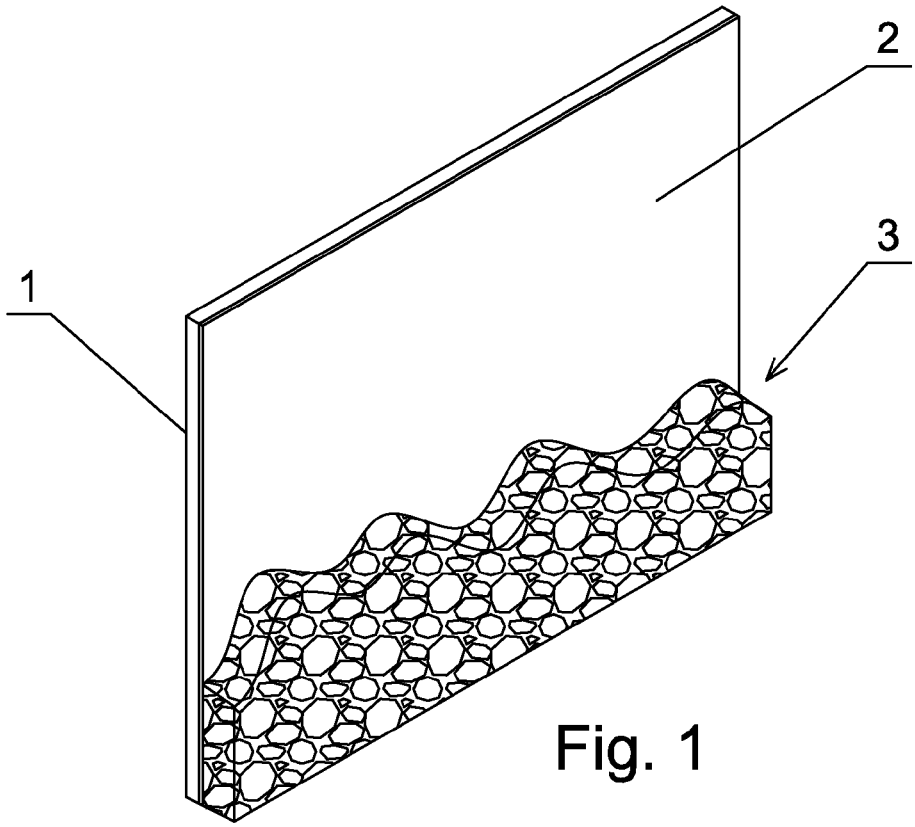
FIG. 1 shows the first embodiment of the electric fireplace flame curtain with fixed simulated charcoal bed according to the present invention.
Figure 5:
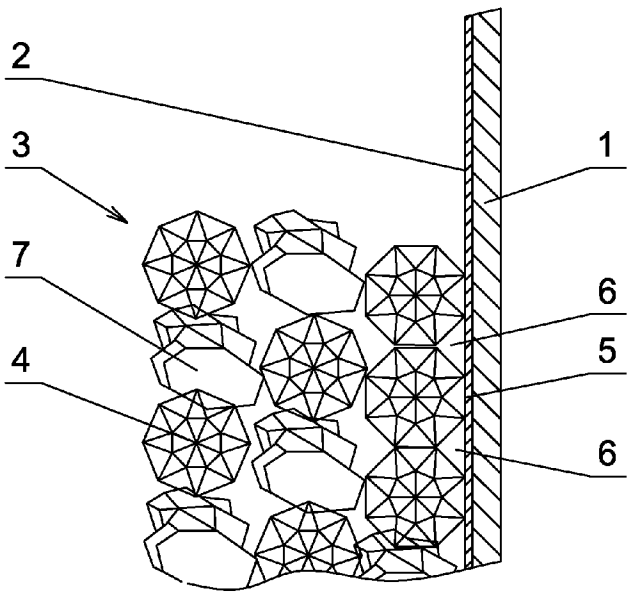
FIG. 5 shows a partial view of the electric fireplace flame curtain with fixed simulated charcoal bed.

As shown in FIG. 1, an electric fireplace flame curtain with fixed simulated charcoal bed comprises a transparent plate, the transparent plate 1 is a plate grass with red color, one of the plate grass surfaces with mat frosting structure forms an imaging mechanism and a charcoal bed is disposed on the mat frosting surface of the bottom portion of the transparent plate 1. A number of fixed light-holding charcoals 4 with plurality of transparent surfaces and a plurality of translucent simulative charcoals 7 with natural charcoal shape are disposed on the charcoal bed 3. A proportion of the simulative charcoals 7 and the light-holding charcoals 4 is 1:6. After mixing the light-holding charcoal 4 and the simulative charcoal 7, and then fixing them on the frosting structure of the transparent plate with set shape, a charcoal bed structure with two to three layers are stick together. The transparent 1, the imaging mechanism 2 and the charcoal bed 3 are of integral fixed structure. The light-holding charcoal 4 is a transparent polyhedron with numerous refracting surfaces, a charcoal flame bright section 5 is formed at where the light-holding charcoals 4 are close to the imaging mechanism 2 or the transparent plate 1, a wedge gap around the charcoal flame bright section is a light-holding section 6 (as shown in FIG. 5).

The flame curtain is disposed in front of an electric fireplace flame generator 8, the side of flame curtain with charcoal bed is near to the flame generator, and the other side faces to users as part of the faceplate of the electric fireplace. The flame generator includes a rotating axis driven by electric machinery and reflecting strips disposed on the rotating axis.

Preferred Embodiment 2

Figure 2:
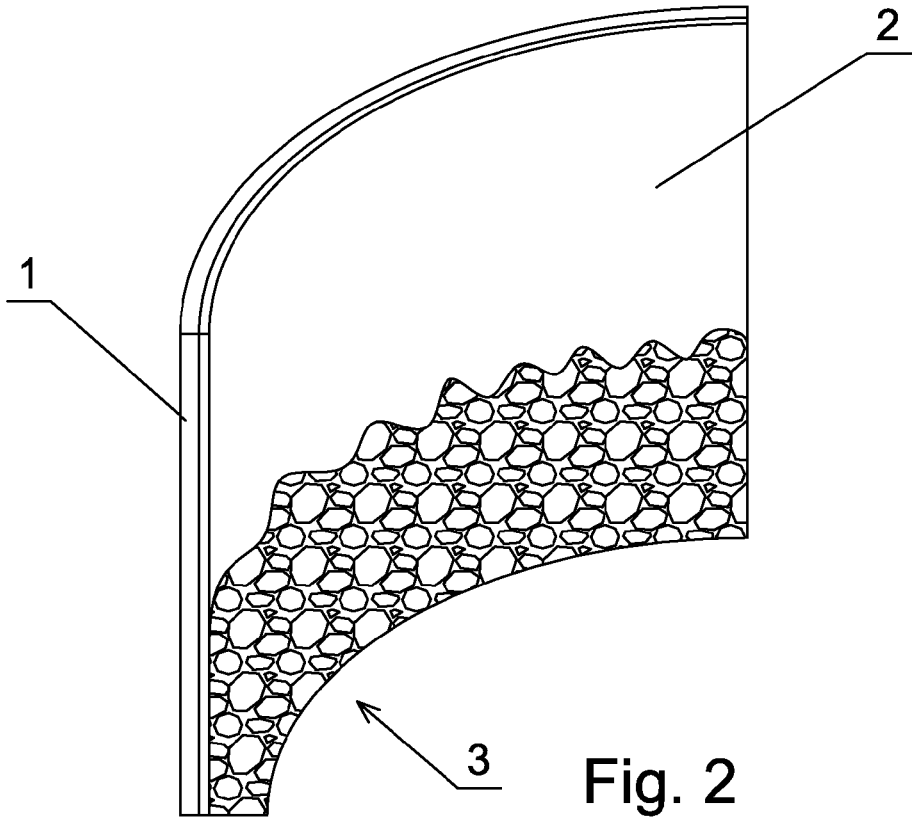
FIG. 2 shows the second embodiment of the electric fireplace flame curtain with fixed simulated charcoal bed according to the present invention.

As shown in FIG. 2, the transparent plate 1 is of a curved surface structure, the imaging mechanism 2 is a thin image screen attached to the transparent plate 1, the size of the thin image screen is smaller than or equal to the size of the transparent plate 1. The imaging mechanism is disposed on the concave side of the transparent plate, and the charcoal bed 3 is disposed on the lower end or the bottom of the transparent plate 1 and the light-holding charcoal 4 is attached on the image screen. A number of light-holding charcoals 4 with plurality of transparent surfaces and a plurality of translucent simulative charcoals 7 with natural charcoal shape are disposed on the charcoal bed 3. A proportion of the simulative charcoals 7 and the light-holding charcoals 4 is 1:4. The other structures are the same as that in the first preferred embodiment.

The flame curtain is disposed in front of an electric fireplace flame generator 8, the concave side of transparent plate is near to the flame generator, and the other side faces to users as part of the faceplate of the electric fireplace. The flame generator is of axis sleeve type including central axis, rotating sleeve and reflecting strips disposed on the rotating sleeve.

Preferred Embodiment 3

Figure 3:
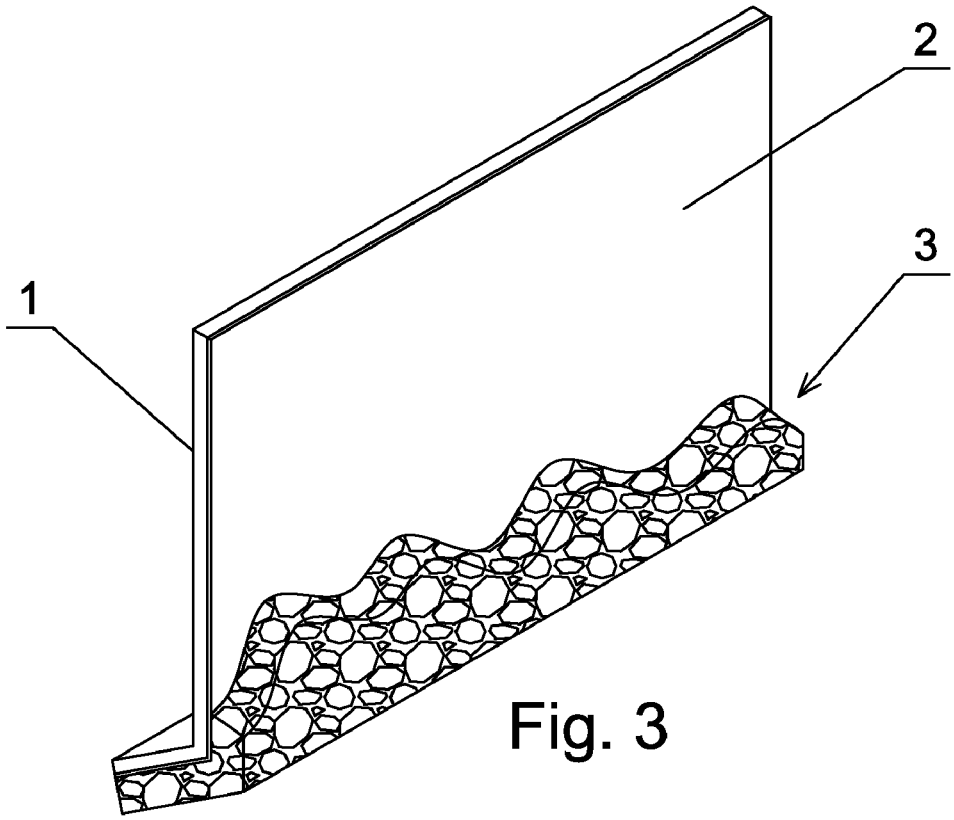
FIG. 3 shows the third embodiment of the electric fireplace flame curtain with fixed simulated charcoal bed according to the present invention.

As shown in FIG. 3, the transparent plate 1 is of a flat surface structure, a lower end of the transparent plate 1 bends forward to be L-shaped portion, the charcoal bed 3 has an L-shaped portion corresponding to the L-shaped portion of the transparent plate 1 and is attached thereon. The charcoal bed 3 is disposed on the image screen at the lower end of the transparent plate 1. A number of light-holding charcoals 4 with plurality of transparent surfaces and a plurality of translucent simulative charcoals 7 with natural charcoal shape are disposed on the charcoal bed 3. A proportion of the simulative charcoals 7 and the light-holding charcoals 4 is 1:2. The other structures are the same as that in the first preferred embodiment.

Figure 6:
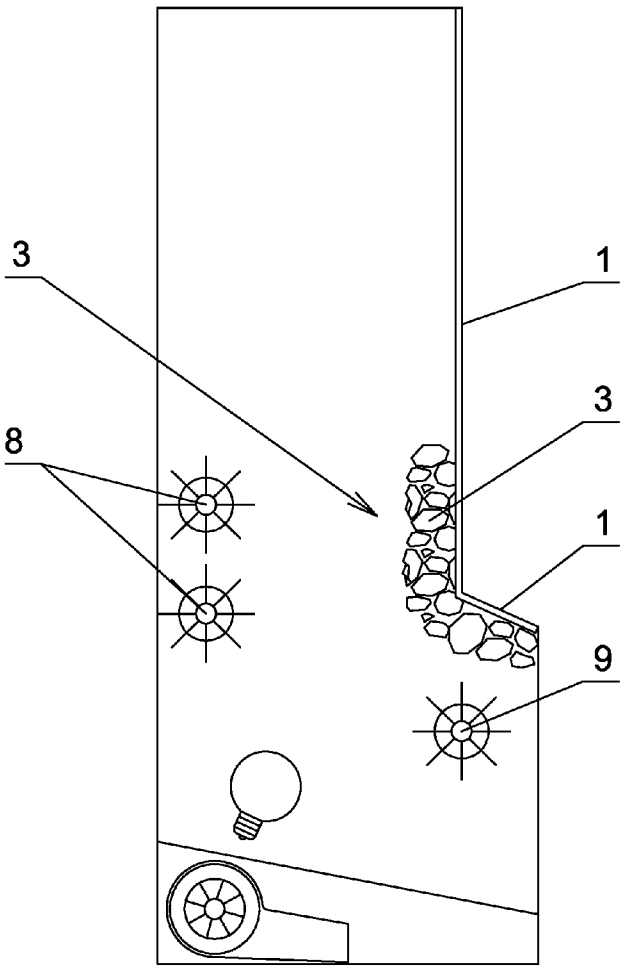
FIG. 6 shows an electric fireplace with the flame curtain of present invention.
Figure 7:
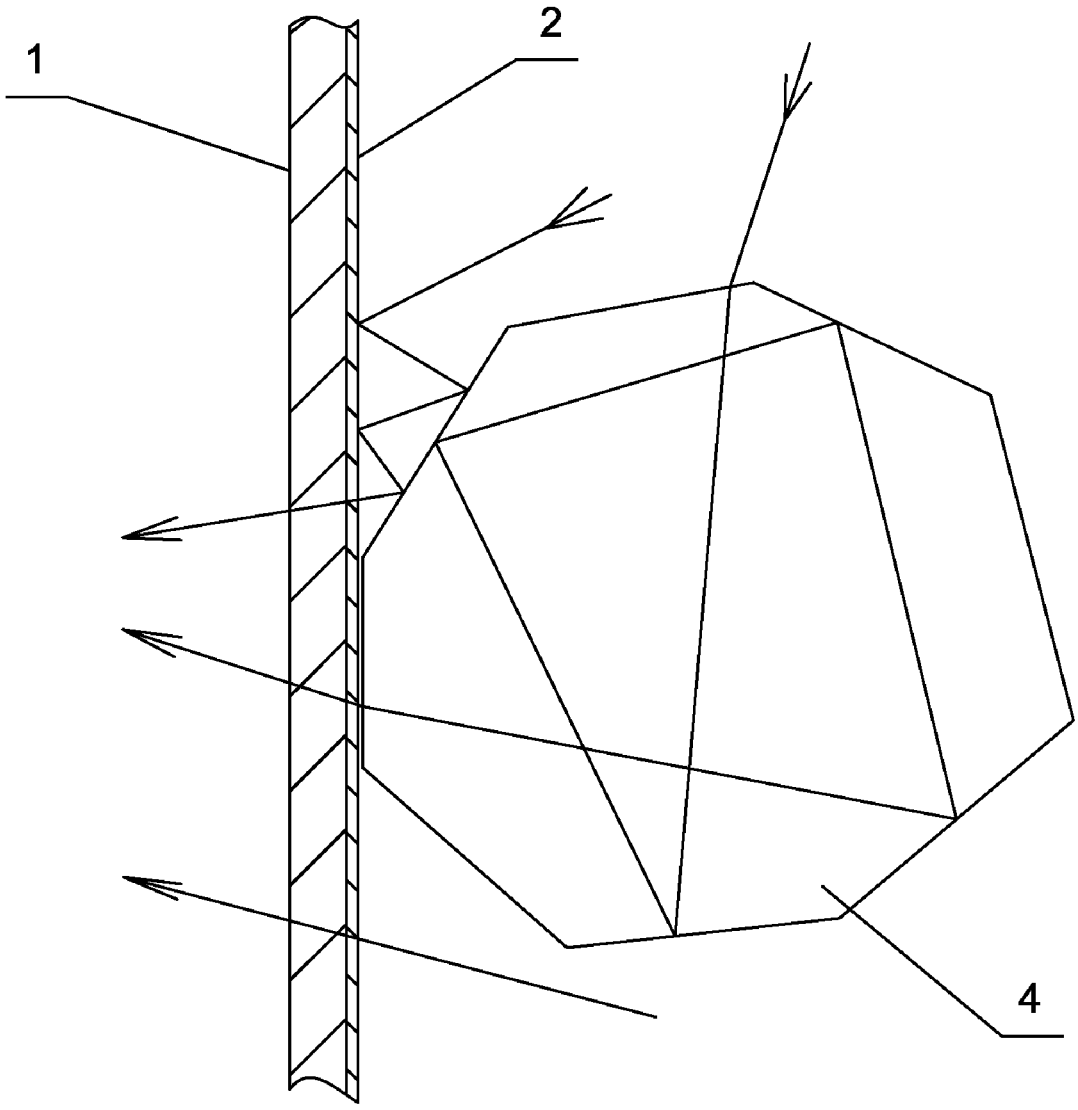
FIG. 7 shows the illustrative view of the light near the light-holding charcoals of the electric fireplace flame curtain with fixed simulated charcoal bed of present invention.

The flame curtain is disposed in front of an electric fireplace flame generator 8, and, a flame generator 9 is disposed below the bending portion of the transparent plate 1 for the bending portion of the transparent plate 1 (as shown in FIG. 6). The flame generator includes a rotating axis driven by electric machinery and reflecting strips disposed on the rotating axis.

Preferred Embodiment 4

Figure 4:
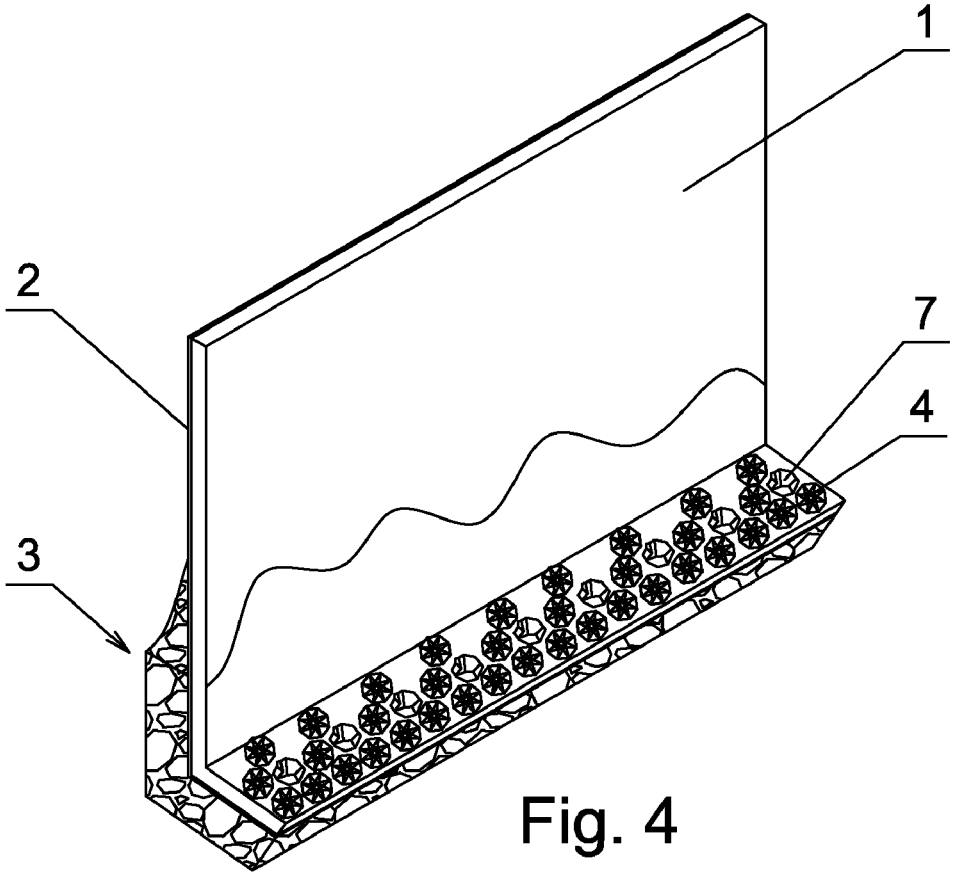
FIG. 4 shows the forth embodiment of the electric fireplace flame curtain with fixed simulated charcoal bed according to the present invention.

As shown in FIG. 4, the transparent plate 1 is of a flat surface structure, a lower end of the transparent plate 1 bends forwards to be L-shaped portion, the charcoal bed has a L-shaped portion corresponding to the L-shaped portion of the transparent plate and is attached thereon. A charcoal bed structure is disposed in the front side of the L-shaped portion, which comprises a number of light-holding charcoals 4 with plurality of transparent surfaces and a plurality of translucent simulative charcoals 7 with natural charcoal shape. A proportion of the simulative charcoals 7 and the light-holding charcoals 4 is 1:8. The light-holding charcoals 4 and simulative charcoals 7 are moveable (as shown in FIG. 4).

Besides the embodiments described above, other kinds of embodiments could be obtained by disposing the imaging mechanism of the present invention in front of the transparent plate or at both sides of the transparent plate, or disposing charcoal bed on the transparent plate piece by piece.

When the electric fireplace with a flame curtain is in use, the flame curtain is disposed in front of the electric fireplace flame generator. The light source of the electric fireplace is reflected to the flame curtain through the flame generator. Image shown at the higher portion of the flame curtain without charcoals disposed beside is basically the same as imaging effect produces by conventional technique. Flame image of burning wood is formed under the projection of the jumping imaging light. When the light is project to the light-holding charcoals at the lower portion of the flame curtain, light at a certain period and with a certain angle focuses on the image screen. Viewing on the image screen, a charcoal bright section is formed where the light-holding charcoals are close to the imaging mechanism, the charcoal bright section is very familiar to sparkling light spots of burning charcoals, and it is perfectly living. Because the light from the flame generator is intermittent, the sparkling light-spots are intermittently bright and shade, which is very similar to burning and lighting circumstance of real charcoal. Besides, some light feels like being held in the charcoal bed after numbers of refraction and reflection by the light-holding charcoal, meanwhile, some light project directly onto the image screen, some light reflect several times by the surface of the light-holding charcoal, that is to say numerous reflections in the wedge gap, and superposition of several lights, together with the remained visual and the image combination function of individual brain, the a light-holding section is formed in the wedge gap around the charcoal flame bright section which makes people feel like that the flame stays near the gap space of the charcoals and burns with a rolling and phantasmagoric configuration, further improves the reality of the charcoal bed and the visual aesthetic feeling of the electric fireplace. As to the simulative charcoals with translucent structure disposed on the charcoal bed, they are less pervious to light and thus look darker on the image screen, and thereby some charcoals with less burning level appear in the charcoal bed. Under the projection of the light from the electric fireplace flame generator and the refracting and reflecting light from the light-holding charcoals with polyhedron structure, the brightness at the outline of the charcoal is greater than the brightness at the center of the charcoal. Such structure conforms to the structure characteristics when charcoals start burning, and thus the simulation effect of the charcoal is obviously improved.

For the bending L-shaped structure at the lower portion of the transparent plate, the bending section of the transparent plate is almost horizontal, the light at the back of the transparent plate is hard to form an effective simulative image on the bending section of the imaging mechanism. The illuminating light depends mainly on the flame generator below which makes the intermittently sparkling light-spots of charcoal simulated on the bending section of imaging mechanism, in this way the three-dimensional feeling of the charcoal flame is much improved. The upper and lower charcoal flame are connected more naturally and close to the natural shape of the charcoal flame. Besides, a number of movable charcoals are disposed on the front of the bending section. The shape of charcoal bed changes with the structure proportion and the relative position of these charcoals. In this way, not only the appearance of the charcoal bed but also the refraction and reflection light path of the light inside the charcoal bed, the bright section and the light-holding section changes according to the charcoal shape. Therefore, a brand new appearance presents in front of the users with a completely different visual effect.

What is claimed is:

1. An electric fireplace flame curtain with fixed simulated charcoal bed comprising:

a transparent plate, an imaging mechanism and a charcoal bed being disposed at a back of the transparent plate, a number of transparent light-holding charcoals with plurality of refracting surfaces fixed on the imaging mechanism, and, a plurality of translucent simulative charcoals with natural charcoal shape disposed on the charcoal bed; and, a proportion of the simulative charcoals and the light-holding charcoals being from 1:2 to 1:8, and the transparent plate, the imaging mechanism and the charcoal bed being of integral structure.

2. The electric fireplace flame curtain with fixed simulated charcoal bed as claimed in claim 1, wherein the flame curtain is disposed in front of an electric fireplace flame generator, the flame generator having a rotating axis driven by electric machinery and reflecting strips disposed on the rotating axis, or the flame generator being of axis sleeve type having a central axis, rotating sleeve and reflecting strips disposed on the rotating sleeve.

3. The electric fireplace flame curtain with fixed simulated charcoal bed as claimed in claim 1, wherein a lower end of the transparent plate bends forward to be an L-shaped portion, and the charcoal bed has an L-shaped portion corresponding to the L-shaped portion of the transparent plate and is attached thereon.

4. The electric fireplace flame curtain with fixed simulated charcoal bed as claimed in claim 3, wherein a flame generator is disposed below the bending section of the transparent plate, the flame generator having a rotating axis driven by electric machinery and reflecting strips disposed on the rotating axis, or the flame generator being of axis sleeve type having a central axis, rotating sleeve and reflecting strips disposed on the rotating sleeve.

* * * * *